US007511239B2

(12) United States Patent
Hawken et al.

(10) Patent No.: US 7,511,239 B2
(45) Date of Patent: Mar. 31, 2009

(54) SIMULTANEOUS CONTROL OF MULTIPLE LIQUID LEVEL SETTINGS IN A DIAPHRAGM VALVE, USING A SINGLE ROTATABLE CONTROL SHAFT

(75) Inventors: Philip C. Hawken, Darien, IL (US); Jerome C. Klopp, Arlington Heights, IL (US); Robert J. Van der Linde, Aurora, IL (US); Paul H. Tuma, Lombard, IL (US)

(73) Assignee: Robertshaw Controls Company, Carol Stream, IL (US)

( * ) Notice: Subject to any disclaimer, the term of this patent is extended or adjusted under 35 U.S.C. 154(b) by 808 days.

(21) Appl. No.: 11/096,279

(22) Filed: Mar. 31, 2005

(65) Prior Publication Data

US 2006/0219538 A1 Oct. 5, 2006

(51) Int. Cl.
*H01H 35/34* (2006.01)

(52) U.S. Cl. ..... 200/83 R; 200/83 WM

(58) Field of Classification Search ..... 200/83 R, 200/83 WM, 83 A, 83 B, 83 J, 83 P, 83 N, 200/83 S See application file for complete search history.

(56) References Cited

U.S. PATENT DOCUMENTS 2,885,879 A 5/1959 Bloom
3,397,716 A 8/1968 Andersson
3,617,665 A * 11/1971 Berson et al. ..... 200/83 P
3,670,533 A 6/1972 Worst
3,875,359 A 4/1975 Backus
3,918,457 A 11/1975 Racenis
4,007,344 A * 2/1977 Hipple ..... 200/83 SA
4,081,637 A * 3/1978 Stearley et al. ..... 200/83 WM
4,990,728 A * 2/1991 Joyce ..... 200/83 P
5,187,338 A * 2/1993 Kaigler ..... 200/83 R
5,530,215 A * 6/1996 Couvreur ..... 200/83 R
6,346,681 B1 * 2/2002 Joyce et al. ..... 200/83 S

* cited by examiner

*Primary Examiner*—Lincoln Donovan
*Assistant Examiner*—Marina Fishman
(74) *Attorney, Agent, or Firm*—Reinhart Boerner Van Deuren P.C.

(57) ABSTRACT

A method and apparatus are provided for simultaneously changing multiple liquid level settings in a liquid-level switch including a diaphragm actuated pressure switch apparatus having a first and a second switch, through use of an actuator apparatus including a single control knob shaft rotatably connected to the pressure switch apparatus and having a first and a second cam fixedly attached to the shaft for rotation therewith, the first cam being operatively connected to provide a biasing force against actuation of the first switch, and the second cam being operatively connected to provide a biasing force against actuation of the second switch.

20 Claims, 4 Drawing Sheets

SIMULTANEOUS CONTROL OF MULTIPLE LIQUID LEVEL SETTINGS IN A DIAPHRAGM VALVE, USING A SINGLE ROTATABLE CONTROL SHAFT

FIELD OF THE INVENTION

This invention relates to pressure switches, and in particular to diaphragm actuated pressure switches of the type used to control the water level in washing machines.

BACKGROUND OF THE INVENTION

It is desirable to provide an operator with the capability of washing various fabrics and/or various sizes of loads of clothing in the same washing machine. To this end, automatic washing machines have long provided control features which allow the operator to vary the amount of water placed in the tub of the washing machine to match the size of the load of clothing to be laundered. If a small load is to be washed, then only a low level of water is needed. If a large load is to be washed, then a full level of water is required. The level of the water in the tub of the washing machine may also be varied for successive cycles in a laundering sequence, depending on whether a large or small load is being washed, and dependent upon other factors such as the degree of soiling to be removed, and whether the clothing is of a sturdy or delicate construction.

Water levels during various cycles of a given laundering process may also be varied to save energy by cutting down on the amount of heated water which is utilized, to thereby achieve higher energy efficiency ratings for the washing machine. In order to provide more functionality for the operator, and to improve energy efficiency, it has been necessary, through the years, that the water level control devices and systems used in automatic washing machines become more sophisticated. In order to provide the additional sophistication, without imposing undesirable additional costs and burden on the operator, it is desirable that a single, simple, adjustment of an operating mode selector by the operator be capable of simultaneously providing adjustment of multiple water level set points in the water level control mechanism.

Although the control of multiple water level settings can be accomplished relatively easily through the use of electronic control systems, such systems tend to be expensive in comparison to approaches where the water level settings of a liquid-level control switch are manually adjustable with a rotatable control knob. Unfortunately, heretofore, it has been necessary to provide several liquid level control switches, each having a separate control knob, in order to match the functionality provided by electronic systems. Having multiple manually operated liquid level control switches is undesirable in that operation of the washing machine becomes more complex for the operator, and results in undesirable increases in cost and reductions in reliability of the washing machine.

It is desirable, therefore, that an improved method and apparatus be provided for controlling liquid level in a washing machine through use of a minimum number of liquid level control switches having rotatable control knobs.

It is further desirable, in order to reduce inventory requirements and costs for the manufacturers of washing machines, that an improved method and apparatus be provided for constructing and operating a manually adjustable liquid-level control switch. In particular, it is desired that such an improved method and apparatus allow for external adjustment of water levels to be set simultaneously in accordance with a single manual input, so that washing machine manufacturers can readily make adjustments required to set the water levels to values desired for individual brands or models of machines.

BRIEF SUMMARY OF THE INVENTION

The invention provides a method and apparatus for simultaneously changing multiple liquid level settings in a liquid-level switch including a diaphragm actuated pressure switch apparatus having a first and a second switch, through use of an actuator apparatus including a single control knob shaft rotatably connected to the pressure switch apparatus. The single control knob shaft has a first and a second cam fixedly attached to the shaft for rotation therewith, the first cam being operatively connected to provide a biasing force against actuation of the first switch, and the second cam being operatively connected to provide a biasing force against actuation of the second switch.

The biasing force against actuation of at least one of the first and second switches of the pressure switch apparatus may be externally adjustable. The control knob shaft, with the first and second cams attached, may be replaceable externally of the pressure switch apparatus. At least one of the first and second cams may include two or more steps thereupon, for providing alternate biasing of its respective switch as the shaft is rotated. In some forms of the invention, the first and second cams may each include two or more steps thereupon, for providing alternate biasing of their respective switches as the shaft is rotated. The invention may also be practiced in forms having more than two switches with biasing forces against actuation being simultaneously adjustable by rotation of the same, single control knob shaft.

In some forms of the invention, the single control knob shaft is rotatable about an axis of rotation, and the first and second switches are disposed on opposite sides of the axis of rotation. The first and second switches may each be operatively attached to their respective first and second cams by first and second cam followers positioned along the axis of rotation of the control knob shaft.

The invention may also take the form of an actuator apparatus, for a liquid-level switch including a diaphragm actuated pressure switch apparatus having first and second diaphragm actuated switches.

In one form of the invention, a method is provided for operating a liquid-level switch including a diaphragm actuated pressure switch apparatus having a first and second switch. A method, in accordance with the invention, may include simultaneously providing predetermined biasing forces to the first and second switches with a single control knob shaft rotatably connected to the pressure switch apparatus and having a first and second cam fixedly attached to the shaft for rotation therewith. The first cam is operatively connected to provide a biasing force against actuation of the first switch and the second cam is operatively connected to provide a biasing force against actuation of the second switch. Where the first and second cams each include two or more steps thereupon, for providing alternate biasing of their respective switches as the shaft is rotated, a method in accordance with the invention may further include simultaneously changing the biasing forces applied to the first and second switches by rotating the control knob shaft.

Other aspects, objectives and advantages of the invention will become more apparent from the following detailed description when taken in conjunction with the accompanying drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
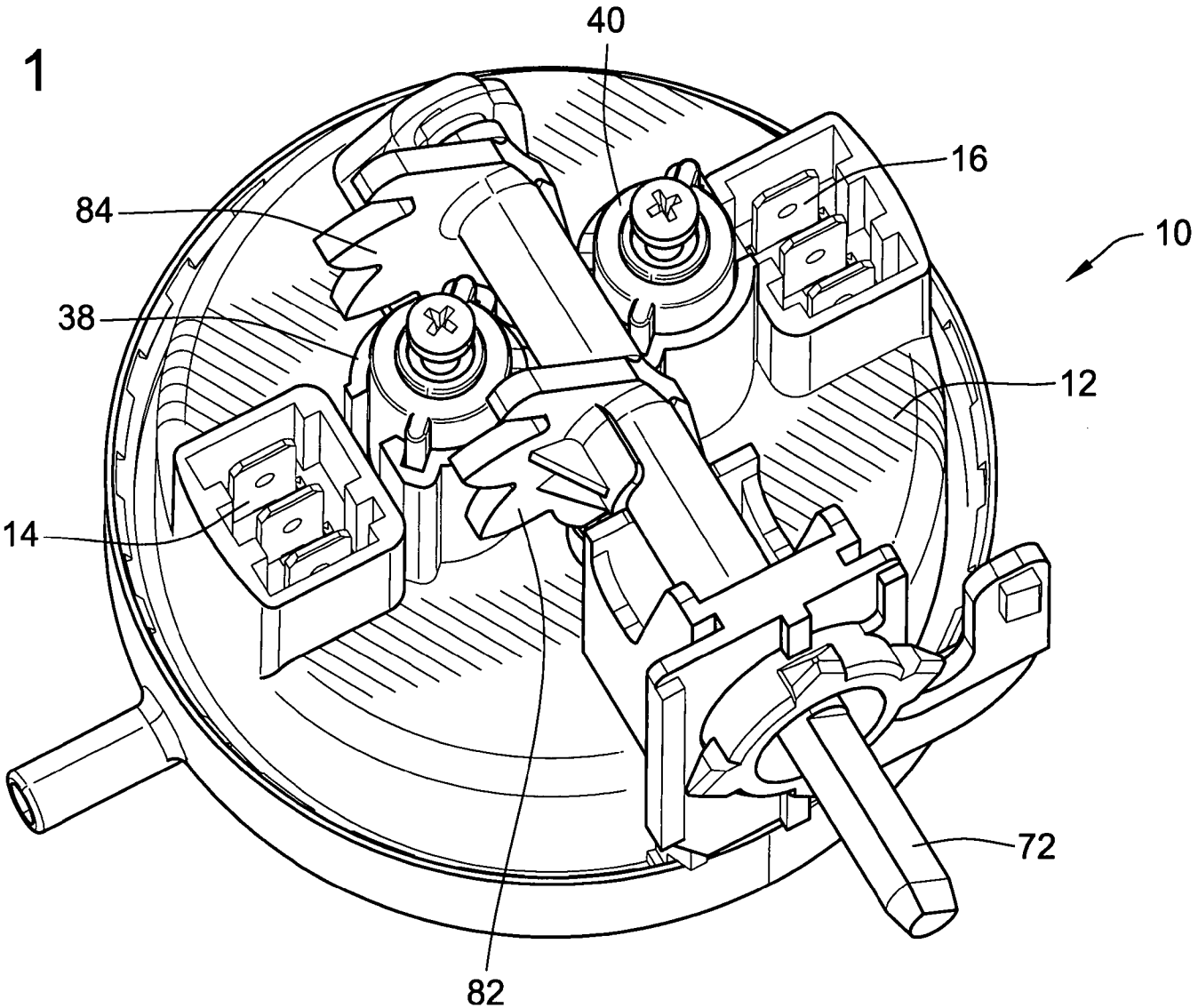
FIG. 1 is a perspective illustration of an exemplary embodiment of a liquid-level switch, according to the invention.

FIG. 1 shows an exemplary embodiment of a liquid-level switch 10, including a diaphragm actuated pressure switch 12 having a first and a second switch 14, 16, with only the electrical contacts of the first and second switches 14, 16 being visible in FIG. 1. The first and second switches 14, 16 of the exemplary embodiment of a snap-action bell-spring biased type commonly utilized in the industry, and are therefore not further described, other than being illustrated pictorially in FIG. 2. It is noted, however, that the invention may be practiced with other forms of switches.

Figure 2:
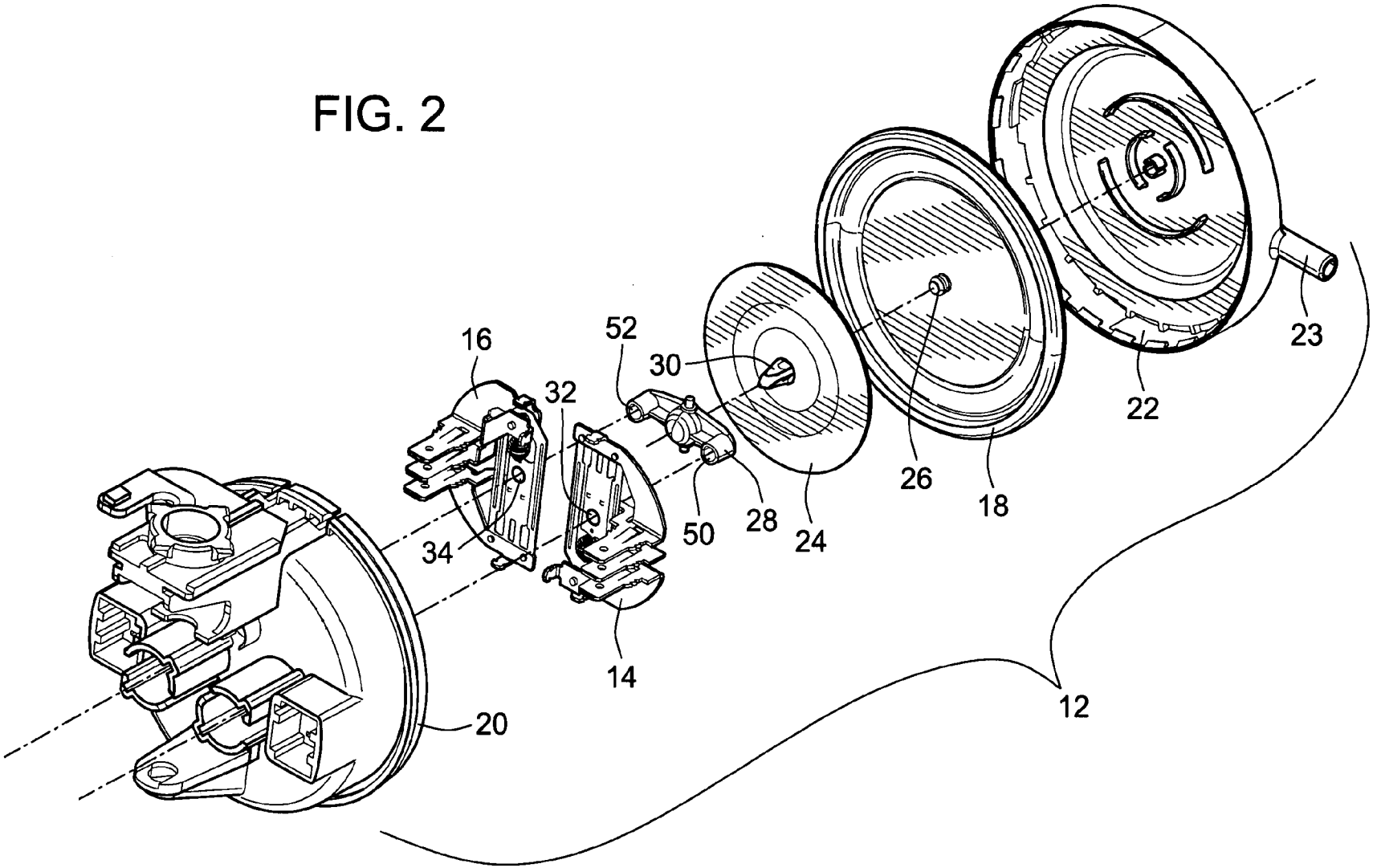
FIG. 2 is an exploded perspective illustration of a diaphragm actuated pressure switch apparatus, of the exemplary embodiment of the liquid-level switch shown in FIG. 1.

As shown in FIG. 2, the diaphragm actuated switch apparatus 12 includes a flexible diaphragm 18 having an outer rim clamped between a housing 20 and a pressure dome 22 of the pressure switch apparatus 12. The first and second switches 14, 16 are attached to the inside of the housing 20. The pressure dome 22 includes an air inlet 23 which is adapted for operative connection, in the manner known in the art, to supply pressurized air to a cavity formed between the dome 22 and the diaphragm 18, with the supplied pressure being proportional to the water level in the tank of the washing machine.

A diaphragm pad 24 snaps onto a center nub 26 on the housing side of the diaphragm 18. A rocking arm 28 is pivotably mounted on a centrally located post 30 extending toward the housing from the diaphragm pad 24. The two distal ends of the rocking arm 28 are spaced to align with through holes 32, 34 in actuating tongues of the first and second switches 14, 16, for receipt of portions of an actuator apparatus 36 to be described in greater detail below.

Figure 3:
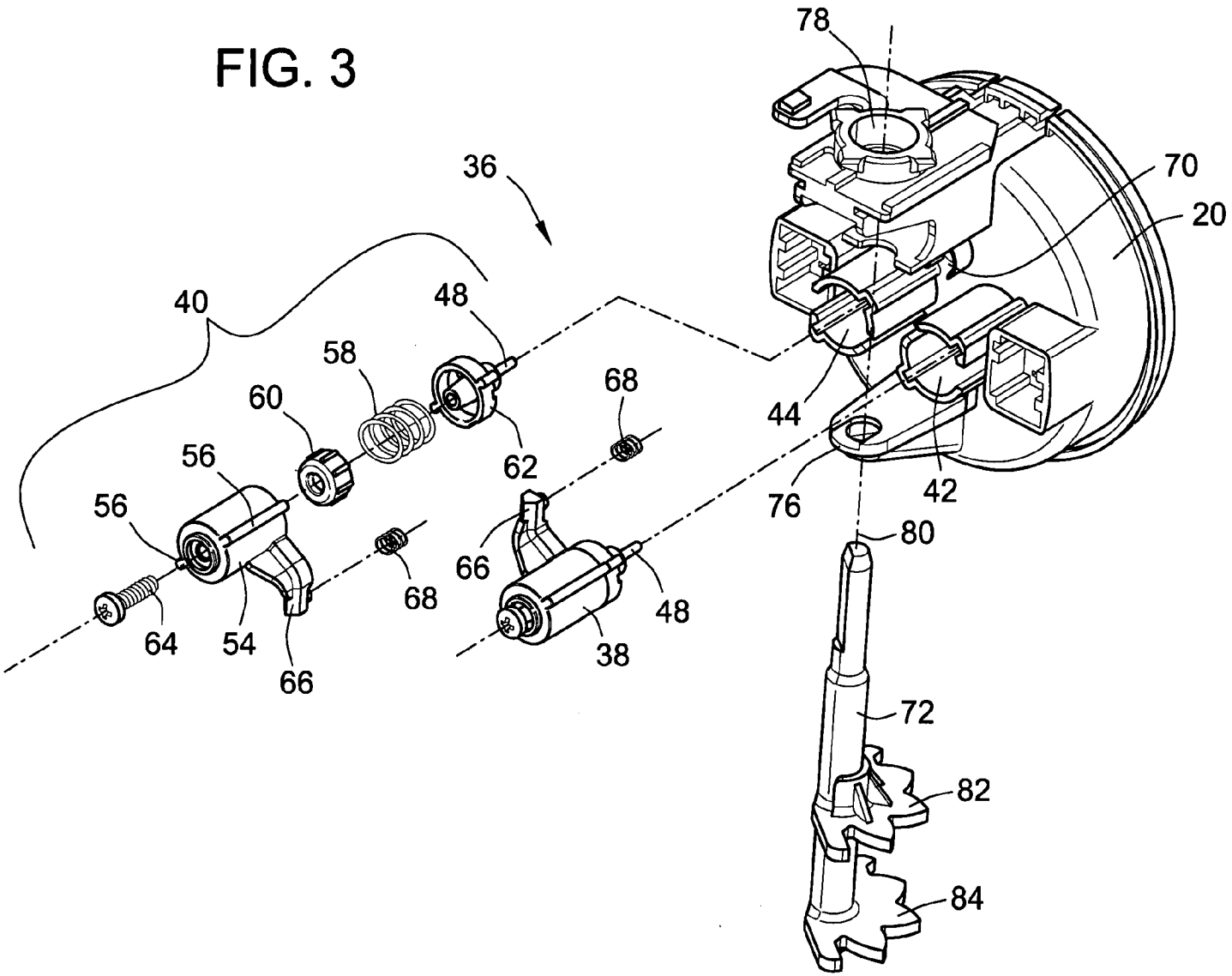
FIG. 3 is an exploded perspective illustration of an actuator apparatus, of the exemplary embodiment of the liquid-level switch shown in FIG. 1.
Figure 4:
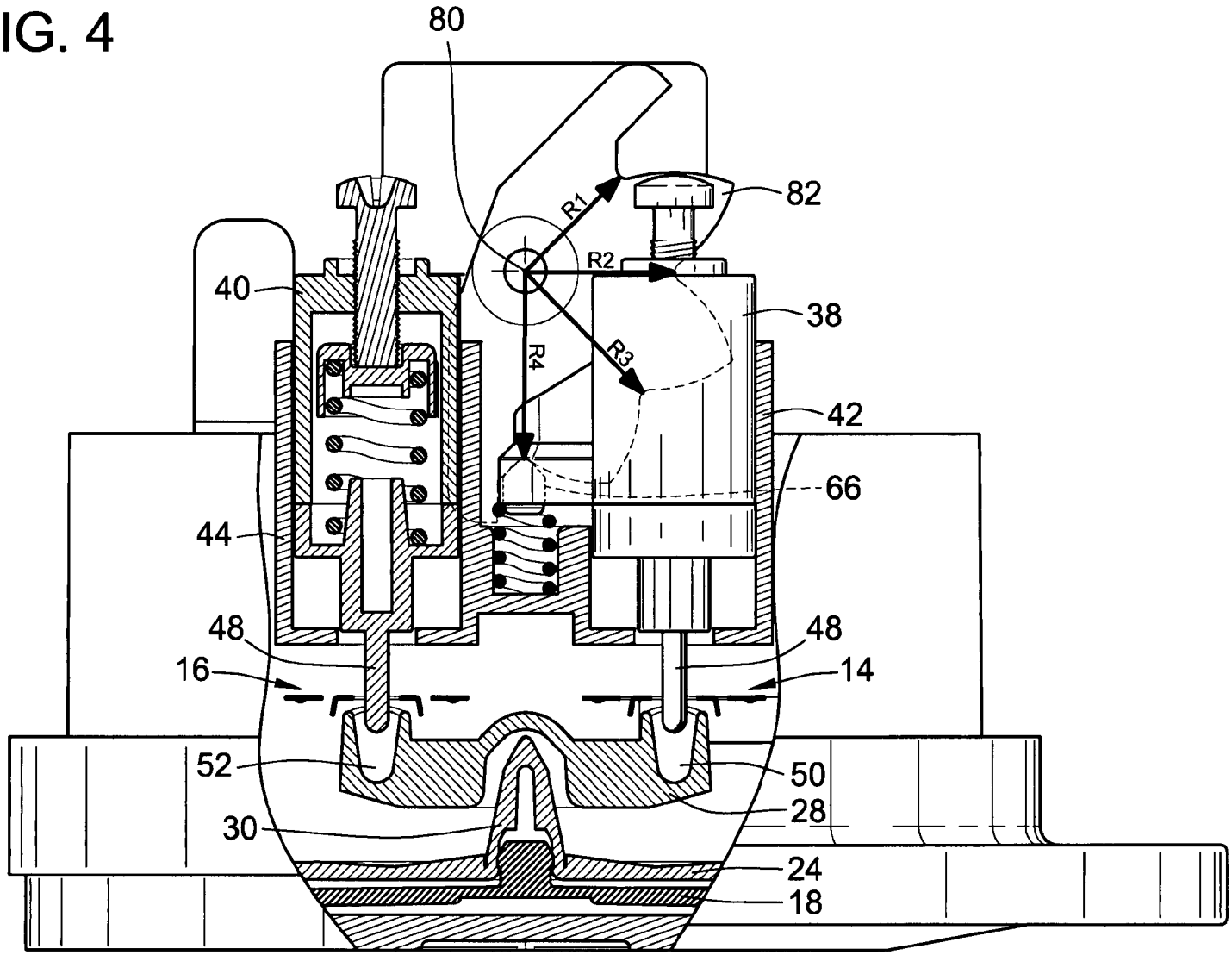
FIG. 4 is a partial orthographic cross-section of the liquid-level switch of FIG. 1, illustrating interconnections between components of an actuator apparatus of the switch of FIG. 1.

As shown in FIG. 3, the exemplary embodiment of the liquid-level switch 10 includes an actuator apparatus 36 having a first and a second adjustable bias spring cartridge 38, 40 which are slidably received in a first and a second keyed receptacle 42, 44 of the housing 20. The first and second adjustable bias spring cartridges 38, 40 each have an actuation pin 48 extending therefrom, for engagement with a pair or receptacles 50, 52 at the distal ends of the rocking arm 28 as shown in FIGS. 2 and 4.

The first and second adjustable bias spring cartridges 38, 40 are identical to one another. Accordingly, only the inner construction of the second adjustable bias spring cartridge 40 will be described in detail with regard to the exploded view shown in FIG. 3. Each of the first and second adjustable bias spring cartridges 38, 40 includes a cup shaped cylinder 54 having a pair of keys 56 on an outer surface thereof for engagement with mating keys in the first and second keyed receptacles 42, 44 of the housing 20. A bias spring 58 is disposed within the cylinder 54 between a threaded top cap 60 and a bottom cap 62 having the actuator pin 48 extending therefrom. An adjustment screw 64 is threaded through an opening in the closed end of the cylinder 54 and into a threaded recess in the threaded top cap 60, so that the compression of spring 58 can be adjusted to apply more or less bias, through the actuator pin 48 to one of the receptacles 50, 52 in the distal ends of the rocking arm 28. By adjusting the position of the screw 64, the amount of force which must be applied to the underside of the switches 14, 16 by the diaphragm 18 to cause actuation of the switchs 14, 16 can also be varied.

The cylinder 54 of each of the first and second adjustable bias spring cartridges 38, 40 also has a cam follower arm 66 projecting therefrom. A pair of follower detent springs 68 are operatively connected between the distal ends of the cam follower arms 66 and a pair of detent spring receptacles 70 in the housing 20.

The actuator apparatus 36 also includes a single control knob shaft 72 rotatably mounted in a pair of apertured projections 76, 78 extending from the housing 20, for rotation about an axis of rotation 80. The single control knob shaft 72 includes a first and a second cam 82, 84 fixedly attached to the shaft 72 for rotation therewith. When the control knob shaft 72 is operatively attached to the housing 20, a stepped surface of the first cam 82 is operatively connected to bear against the cam follower arms 66 of the first adjustable bias spring cartridge 38 to provide a biasing force through the cartridge 38 into the receptacle 50 at one distal end of the rocking arm 28 for biasing the first switch 14 against actuation. In similar fashion, when the control knob shaft 72 is operatively attached to the housing 20, a stepped cam surface of the second cam 84 engages the cam follower arms 66 of the second adjustable bias spring cartridge 40 to provide a biasing force through the second cartridge 40 into the receptacle 52 at the opposite end of the rocking arm 28 to thereby provide a biasing force against actuation against of the second switch 16.

As indicated in FIG. 4, the steps of the first and second cams 82,84 are contoured to provide several troughs at various distances $R_1$-$R_4$ from the axis of rotation 80 of the shaft 72. As the shaft 72 is rotated, the first and second cams 82, 84 move the followers 66 of the first and second spring biasing cartridges 38, 40 toward or away from the diaphragm 18, to thereby simultaneously change the spring bias required to actuate the first and second switches 14, 16. Changing the spring bias required for actuation of the switches 14, 16 changes the water level required for actuation of the switches 14, 16.

By virtue of the construction described above, the biasing force against actuation of either the first or second switches 14, 16 may also be externally adjusted, by a manufacturer of a washing machine, for example, either by turning the adjustment screws 64 in or out to apply more or less preset biasing force through the springs 58 inside the first and second adjustable bias spring cartridges 38, 40, or by replacing the single control knob shaft 72 with another shaft having different stepped profiles on the first and second cams 82, 84. As will be understood from the preceding description, and the figures, the first and second cams 82, 84 of the single control knob shaft 72 of the exemplary embodiment of the liquid-level switch 10 each include multiple steps for simultaneously applying different combinations of predetermined biasing forces to the first and second switches as the control knob shaft is rotated about the axis of rotation 80.

Those having skill in the art will further notice that in the exemplary embodiment of the liquid-level switch 10, the first and second switches 14, 16 and components of the actuator 36 are disposed at equal distances on opposite sides of the axis of rotation 80 of the single control knob shaft 72. The cam follower arms 66 on the cylinders 54 of the first and second adjustable bias spring cartridges 38, 40 are also configured such that the point of contact between the cam follower arms 66 and the first and second cams 82, 84, as well as the direction of force application of the follower detent springs 68 are all aligned directly under the axis of rotation 80. While it is not necessary in practicing the invention, to configure the components of the switch 10 and actuator assembly 36 to be symmetrical about the axis of rotation 80, such an orientation provides advantages in terms of balanced forces, and allowing the first and second adjustable bias spring cartridges 38, 40 to be identical to one another.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A liquid-level switch, comprising, a diaphragm actuated pressure switch apparatus having a first and a second switch, and a single control knob shaft rotatably connected to the pressure switch apparatus and having a first and a second cam fixedly attached to the shaft for rotation therewith, the first cam being operatively connected to provide a biasing force against actuation of the first switch, and the second cam being operatively connected to provide a biasing force against actuation of the second switch.

2. The liquid-level switch of claim 1, wherein the biasing force against actuation of at least one of the first and second switches of the pressure switch apparatus is externally adjustable.

3. The liquid-level switch of claim 1, wherein the control knob shaft with the first and second cams attached is replaceable externally of the pressure switch apparatus.

4. The liquid-level switch of claim 1, wherein at least one of the first and second cams includes two or more steps thereon for providing alternate biasing of its respective switch as the shaft is rotated.

5. The liquid-level switch of claim 4, wherein the biasing force against actuation of at least one of the first and second switches of the pressure switch apparatus is externally adjustable.

6. The liquid-level switch of claim 4, wherein the first and second cams each include two or more steps thereon for providing alternate biasing of their respective switches as the shaft is rotated.

7. The liquid-level switch of claim 6, wherein the biasing force against actuation of at least one of the first and second switches of the pressure switch apparatus is externally adjustable.

8. The liquid-level switch of claim 1, wherein the control knob shaft is rotatable about an axis of rotation, and the first and second switches are disposed on opposite sides of the axis of rotation.

9. The liquid-level switch of claim 8, wherein the first and second switches are each operatively attached to their respective first and second cams by first and second cam followers positioned along the axis of rotation of the control knob shaft.

10. An actuator apparatus, for a liquid-level switch including a diaphragm actuated pressure switch apparatus having a first and a second diaphragm actuated switch, the actuator apparatus comprising:

a single control knob shaft rotatably connected to the pressure switch apparatus and having a first and a second cam fixedly attached to the shaft for rotation therewith;

the first cam being operatively connected to provide a biasing force against actuation of the first switch, and the second cam being operatively connected to provide a biasing force against actuation of the second switch.

11. The actuator apparatus of claim 10, wherein the biasing force against actuation of at least one of the first and second switches of the pressure switch apparatus is externally adjustable.

12. The actuator apparatus of claim 10, wherein the control knob shaft with the first and second cams attached is replaceable externally of the pressure switch apparatus.

13. The actuator apparatus of claim 10, wherein at least one of the first and second cams includes two or more steps thereon for providing alternate biasing of its respective switch as the shaft is rotated.

14. The actuator apparatus of claim 13, wherein, the biasing force against actuation of at least one of the first and second switches is externally adjustable.

15. The actuator apparatus of claim 13, wherein the first and second cams each include two or more steps thereon for providing alternate biasing of their respective switches as the shaft is rotated.

16. The actuator apparatus of claim 15, wherein the biasing force against actuation of at least one of the first and second switches of the pressure switch apparatus is externally adjustable.

17. The actuator apparatus of claim 10, wherein the control knob shaft is rotatable about an axis of rotation, and the first and second switches are disposed on opposite sides of the axis of rotation.

18. The actuator apparatus of claim 17, wherein the first and second switches are each operatively attached to their respective first and second cams by first and second cam followers positioned along the axis of rotation of the control knob shaft.

19. A method for operating a liquid-level switch including a diaphragm actuated pressure switch apparatus having a first and a second switch, the method comprising simultaneously providing predetermined biasing forces to the first and second switches with a single control knob shaft rotatably connected to the pressure switch apparatus and having a first and a second cam fixedly attached to the shaft for rotation therewith, the first cam being operatively connected to provide a biasing force against actuation of the first switch, and the second cam being operatively connected to provide a biasing force against actuation of the second switch.

20. The method of claim 19, wherein the first and second cams each include two or more steps thereon for providing alternate biasing of their respective switches as the shaft is rotated, and the method further comprises, simultaneously changing the biasing forces applied to the first and second switches by rotating the control knob shaft.

* * * * *